US006097824A

United States Patent [19]

Lindemann et al.

[11] Patent Number: 6,097,824

[45] Date of Patent: Aug. 1, 2000

[54] CONTINUOUS FREQUENCY DYNAMIC RANGE AUDIO COMPRESSOR

[75] Inventors: Eric Lindemann; Thomas Lee Worrall, both of Boulder, Colo.

[73] Assignee: AudioLogic, Incorporated, Boulder, Colo.

[21] Appl. No.: 08/870,426

[22] Filed: Jun. 6, 1997

[51] Int. Cl.[7] ..... H04R 25/00

[52] U.S. Cl. ..... 381/315; 318/313

[58] Field of Search ..... 381/71.11, 71.12, 381/312, 317, 321

[56] References Cited

U.S. PATENT DOCUMENTS

| | | | |
|---|---|---|---|
| 4,246,617 | 1/1981 | Portnoff | 360/32 |
| 4,396,806 | 8/1983 | Anderson | 179/107 FD |
| 4,701,953 | 10/1987 | White | 381/46 |
| 4,718,099 | 1/1988 | Hotvet | 381/68.4 |
| 4,755,795 | 7/1988 | Page | 340/347 SH |
| 5,233,665 | 8/1993 | Vaughn et al. | 381/97 |
| 5,388,182 | 2/1995 | Benedetto et al. | 395/2.14 |
| 5,500,902 | 3/1996 | Stockham, Jr. et al. | 381/68.4 |
| 5,608,803 | 3/1997 | Magotra et al. | 381/68.2 |
| 5,694,474 | 12/1997 | Ngo et al. | 381/66 |

FOREIGN PATENT DOCUMENTS

| | | |
|---|---|---|
| 2707607 | 6/1977 | Germany . |
| 3716329 | 3/1988 | Germany . |

OTHER PUBLICATIONS

Chabries, Douglas M., Richard W. Christiansen, Robert H. Brey, Martin S. Robinette, and Richard W. Harris, "Application of Adaptive Digital Signal Processing to Speech Enhancement for the Hearing Impaired," Journal of Rehabilitation Research and Development 24:4 (1987), pp. 65–74.

Glasberg, Brian R., and Brian C.J. Moore, "Auditory Filter Shapes in Subjects with Unilateral and Bilateral Cochlear Impairments," Journal of the Acoustical Society of Americal 79:4 (1986), pp. 1020–1033.

Killion, Mead C., "The K–Amp Hearing Aid: An Attempt to Present High Fidelity for Persons With Impaired Hearing," American Speech–Language–Hearing Association, AJA (1993), pp. 52–74.

Kollmeier, B., "Speech Enhancement by Filtering in the Loudness Domain," Acta Otolaryngol (Stockh) (1990), Suppl. 469, pp. 207–214.

Lippmann, R.P., L.D. Braida, and N.I. Duriach, "Study of Multichannel Amplitude compression and linear amplification for Persons with Sensorineural Hearing Loss," Journal of the Acoustical Society of America 69:2 (1981), pp. 524–534.

Moore, Brian C.J., "How Much Do We Gain by Gain Control in Hearing Aids?" Acta Otolaryngol (Stockh) (1990), Suppl. 469, pp. 250–256.

(List continued on next page.)

*Primary Examiner*—Curtis A. Kuntz
*Assistant Examiner*—Dionne N. Harvey
*Attorney, Agent, or Firm*—Jennifer L. Bales; Macheledt Bales & Johnson LLP

[57] ABSTRACT

An improved multiband audio compressor is well behaved for both wide band and narrow band signals, and shows no undesirable artifacts at filter crossover frequencies. The compressor includes a heavily overlapped filter bank, which is the heart of the present invention. The filter bank filters the input signal into a number of heavily overlapping frequency bands. Sufficient overlapping of the frequency bands reduces the ripple in the frequency response, given a slowly swept sine wave input signal, to below about 2 dB, 1 dB, or even 0.5 dB or less with increasing amount of overlap in the bands. Each band is fed into a power estimator, which integrates the power of the band and generates a power signal. Each power signal is passed to a dynamic range compression gain calculation block, which calculates a gain based upon the power signal. Each band is multiplied by its respective gain in order to generate scaled bands. The scaled bands are then summed to generate an output signal.

20 Claims, 15 Drawing Sheets

OTHER PUBLICATIONS

Moore, Brian C.J., Brian R. Glasberg, and Michael A. Stone, "Optimization of a Slow–Acting Automatic Gain Control System for Use in Hearing Aids," British Journal of Audiology 25 (1991), pp. 171–182.

Moore, Brian C.J., Jeannette Seloover Johnson, Teresa M. Clark, and Vincent Pluvinage, "Evaluation of a Dual–Channel Full Dynamic Range Compression System for People with Sensorineural Hearing Loss," Ear and Hearing 13:5 (1992), pp. 349–370.

Nabelek, Igor V., "Performance of Hearing–Impaired Listeners Under Various Types of Amplitude Compression," Journal of the Acoustical Society of America 74:3 (1983), pp. 776–791.

Plomp, Reinier, "The Negative Effect of Amplitude Compression in Multichannel Hearing Aids in the Light of the Modulation–Transfer Function, " Journal of the Acoustical Society of America 83:6 (1988), pp. 2322–2327.

Villchur, Edgar, "Comments on 'The Negative Effect of Amplitude Compression in Multichannel Hearing Aids in the Light of the Modulation–Transfer Function'," Journal of the Acoustical Society of America 86:1 (1989), pp. 425–427.

Plomp, Reinier, "Reply to 'Comments on "The Negative Effect of Amplitude compression in Multichannel Hearing Aids in the Light of the Modulation–Transfer Function"'," Journal of the Acoustical Society of America 86:1 (1989), p. 428.

Waldhauer, Fred, and Edgar Villchur, "Full Dynamic Range Multiband Compression In a Hearing Aid," The Hearing Journal (1988), pp. 1–4.

Walker, Gary, Denis Byrne, and Harvey Dillon, "The Effects of Multichannel Compression/Expansion Amplification on the Intelligibility of Nonsense Syllables in Noise," Journal of the Acoustical Society of America 76:3 (1984), pp. 746–757.

Yanick, Jr., Paul, "Effects of Signal Processing on Intelligibility of Speech in Noise for Persons with Sensorineural Hearing Loss," Journal of the American Audiological Society 1:5 (1976), pp. 229–238.

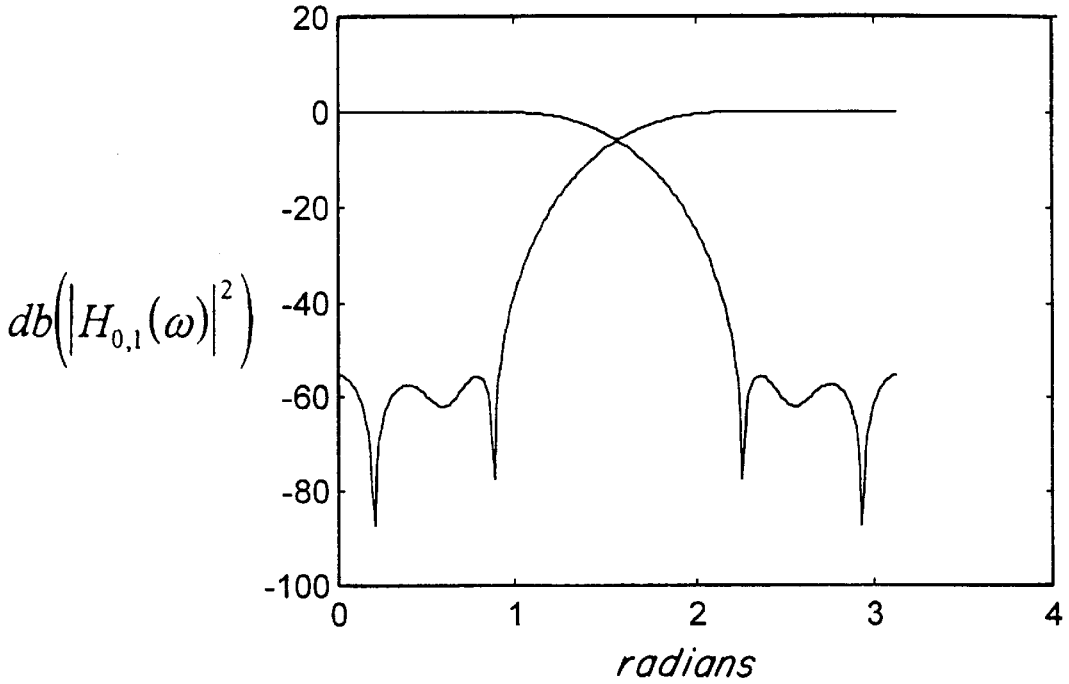
FIG. A1
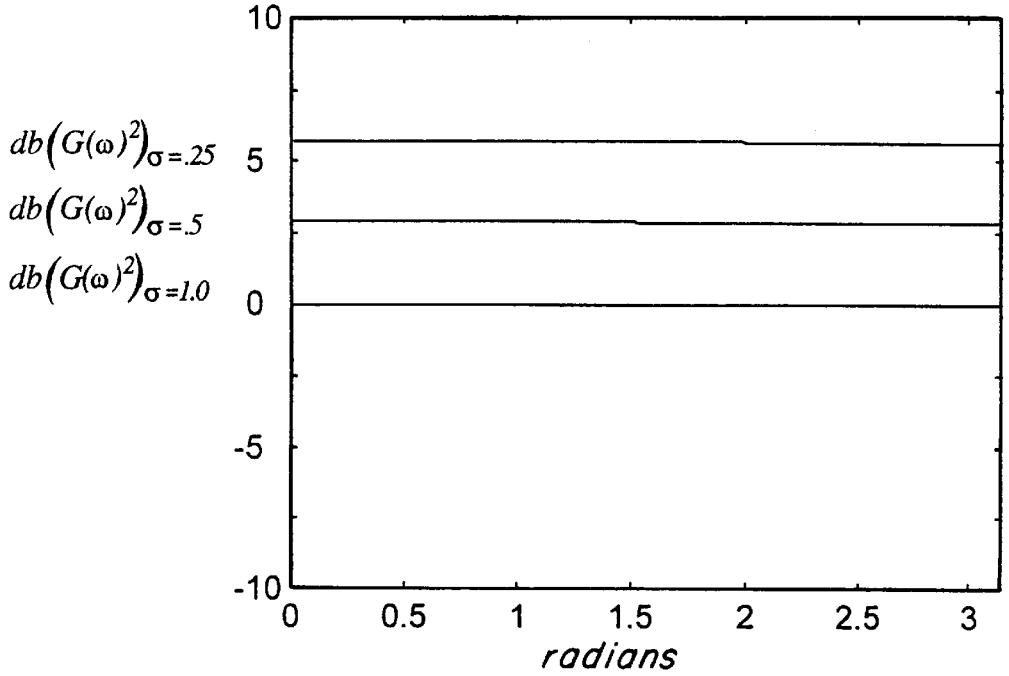
FIG. A2

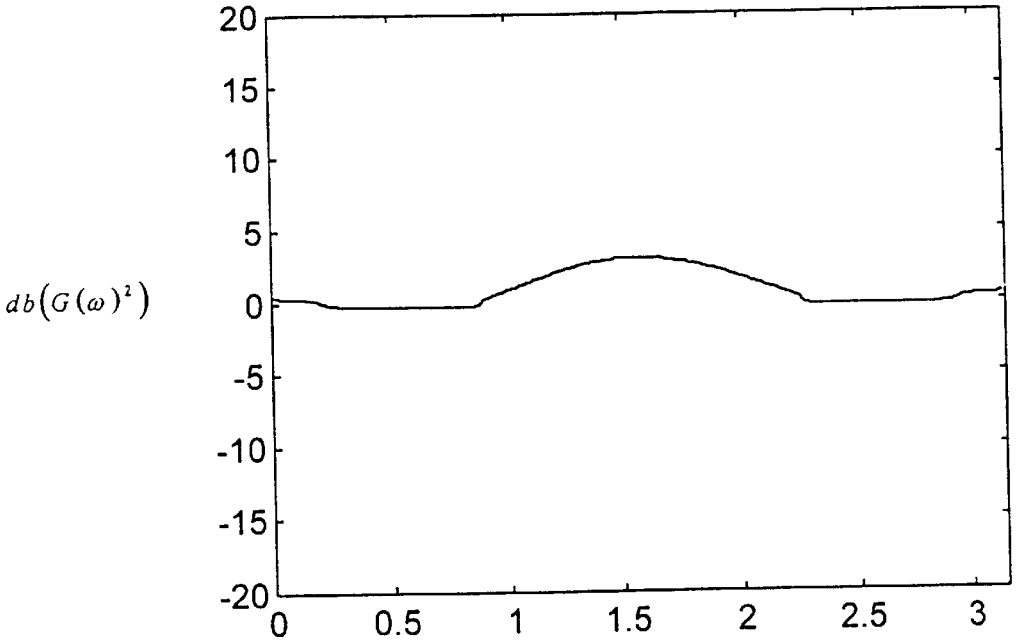
FIG. A3
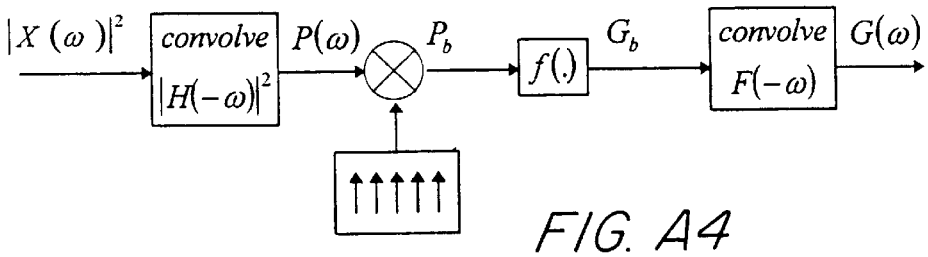
FIG. A4
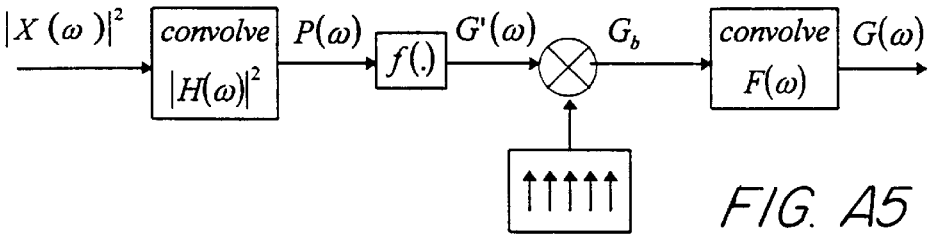
FIG. A5

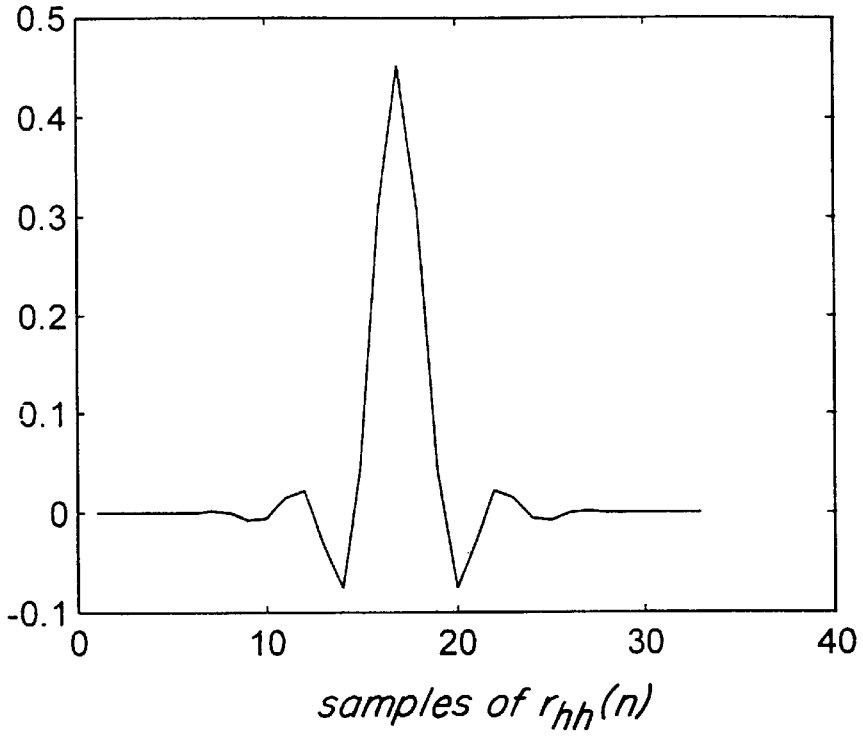
FIG. A6
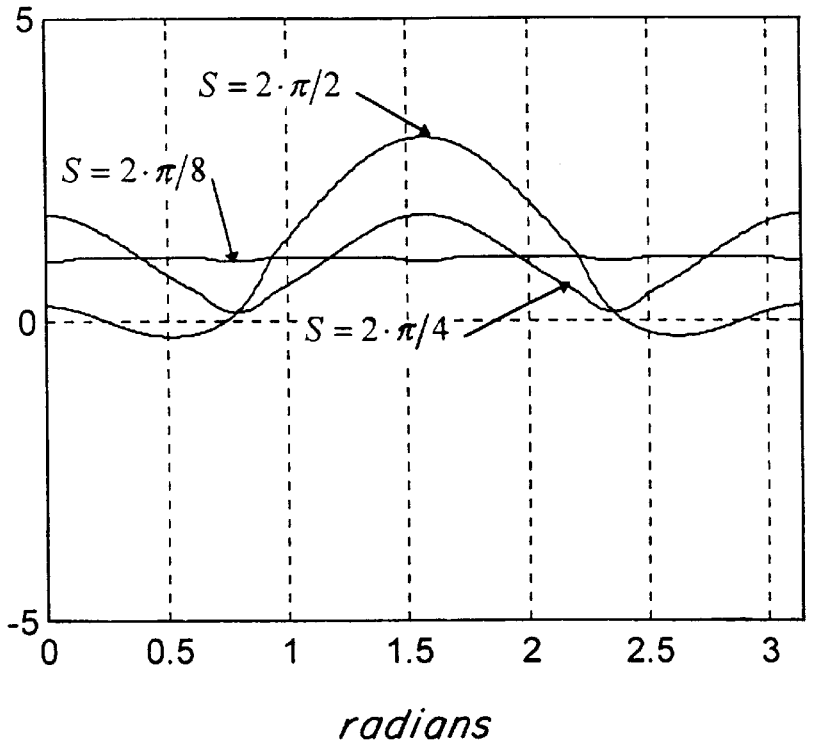
FIG. A7

CONTINUOUS FREQUENCY DYNAMIC RANGE AUDIO COMPRESSOR

BACKGROUND OF THE INVENTION

1. Field of the Invention

The present invention relates to apparatus and methods for multiband compression of sound input.

2. Description of the Prior Art

Multiband dynamic range compression is well known in the art of audio processing. Roughly speaking, the purpose of dynamic range compression is to make soft sounds louder without making loud sounds louder (or equivalently, to make loud sounds softer without making soft sounds softer). One well known use of dynamic range compression is in hearing aids, where it is desirable to boost low level sounds without making loud sounds even louder.

The purpose of multiband dynamic range compression is to allow compression to be controlled separately in different frequency bands. Thus, high frequency sounds, such as speech consonants, can be made louder while loud environmental noises—rumbles, traffic noise, cocktail party babble—can be attenuated.

The pending patent filed Oct. 10, 1995, Ser. No. 08/540, 534 (herein incorporated by reference), entitled Digital Signal Processing Hearing Aid, inventors Melanson and Lindemann, gives an extended summary of multiband dynamic range compression techniques with many references to the prior art.

FIG. 1 (prior art) shows a block diagram of a conventional multiband compressor. The input signal from a microphone 104 or other audio source is divided into frequency bands using a filter bank 106 made up of a plurality of band pass filters, of which three are shown here: 108, 110, and 112. Most multiband compressors in analog hearing aids have two or three frequency bands.

A power estimator (122, 124, 126) estimates the power of each frequency band (114, 116, 118) at the output of each band pass filter. These power estimates are input to a plurality of gain calculation blocks (130, 132, 134) which calculate a gain (138, 140, 142 ) which will be applied to the frequency bands 114, 116, 118. In general, gains 138, 140, and 142 provide more gain for low power signals and less gain for high power signals. The gain is multiplied with the band pass signal and the gain scaled band pass signals 146, 148, 150 are summed by adder 154 to form the final output. This output will generally be provided to a speaker or receiver 158.

When dividing an audio signal into frequency bands, it is desirable to design the filter bank in such a way that, if equal gain is applied to every frequency channel, the sum of the frequency channels is equal to the original input signal to within a scalar gain factor. The frequency response of the sum of the frequency channels should be nearly constant. In practice we can tolerate phase distortion better than amplitude distortion so we will say that the magnitude frequency response of the sum of frequency channels should be nearly constant. Less than 1 dB of ripple is desirable.

FIG. 2 shows the magnitude frequency response of the band pass channels 201 and the magnitude frequency response of the sum of band pass channels 202 of a filter bank designed in the manner described above. In U.S. Pat. No. 5,500,902, Stockham Jr. et al. propose just such a filter bank as the basis of a multiband compressor. The band centers and bandwidths of the filter bank are spaced roughly according to the critical bands of the human ear. This is a quasi-logarithmic spacing—linear below 500 Hz and logarithmic above 500 Hz. It is suggested in U.S. Pat. No. 5,500,902 in column 5 lines 8–9 that the audio band pass filters should preferably have a band pass resolution of ⅓ octave or less. In other words, the band pass filters should be reasonably narrow as indicated in FIG. 2 so that the compression is controlled independently in each band with little interaction between bands.

FIG. 3 shows the magnitude frequency response of the sum of frequency channels 202 for the same filter bank as FIG. 2, but with higher resolution on the Y axis. We can see that the residual ripple is considerably less than 1 dB.

When a multiband compression system, based on such a filter bank, is presented with a broadband signal, such as white noise, it will adjust the gain similarly in each frequency channel. The gains may be weighted so that the wider bands at high frequency, which measure more power because of their increased width, produce gains equivalent to the narrow low frequency bands. The result is a smooth, flat output frequency response.

However, when such a filter bank is presented with a narrow band stimulus, such as a sinusoid slowly swept across frequency, the resulting output response is entirely different, as shown in FIG. 4. The sine wave is swept slowly enough so that the time constants of the compressor are not a factor. We see a pronounced 4.5 dB ripple in the output 401. Here the stimulus is a −20 dB sinusoid sweeping across frequency. The compression ratio in this example is 4 to 1 and the unity gain point of the compressor is 0 dB. Under these conditions, we would expect the compressor to generate 15 dB of gain so that the resulting output is a constant −5 dB. This is clearly not the case.

As we recall, the filter bank is designed to sum to a constant response. This means at the filter crossover frequencies, where the response of adjacent band pass filters is the same, the band pass response is −6 dB. Since the responses are the same at this point they will sum, giving a total of 0 dB which preserves the overall flat response. However, when a sinusoid is presented at a crossover frequency the power measurement is also −6 dB relative to the band center. The compressor in each band sees this −6 dB output and, since the compression ratio is 4 to 1, generates a gain of 4.5 dB which appears on the output as shown in FIG. 4. Note that the ripple would be smaller for a system having a lower compression ratio. For a compression ratio of 1.5, the ripple would be around 2 dB, which is still quite significant.

For narrow band signals which change frequencies this will generate an undesirable audible warble. This would certainly be the case for musical sounds—flutes, violins, etc. It would also be the case for high pitched speech sounds from women and children where the individual harmonics of voiced speech are relatively far apart and will appear as individual stimuli. As the formants of the voiced speech sweep across frequency they will become distorted by the narrow band ripple shown in FIG. 4.

In addition, audiologists often test the frequency response of hearing aids with pure tone sinusoids of different frequencies. The results of their tests will clearly be compromised given the response of FIG. 4.

For illustrative reasons, in FIG. 5 we have decreased the number of bands to three bands, 501, 502, and 503. This is considerably fewer bands than the FIG. 2 configuration, but the filter bands are conventionally overlapped, and the ripple or warble problem remains the same as in the FIG. 2 configuration. In FIG. 5, the filter transfer functions are plotted using different symbols for each filter. Thus, frequency band 501 is plotted with squares, frequency band 502 is plotted with triangles, and frequency band 503 is plotted with asterisks. The band transitions in the FIG. 5 configuration are relatively sharp and there is just enough overlap to guarantee that the sum of the magnitude frequency responses of the filters is constant, as shown by 504, which indicates the broadband frequency response of the configuration. However, as shown in FIG. 6, the slowly swept sine response 601 of the 4 to 1 compressor manifests a 4.5 dB ripple, just as was seen in FIG. 4.

This poor response to narrow band inputs is true for any compressor with relatively narrow transition bands (conventional overlap) between band pass filters. In particularly it is true for both digital and analog hearing aids with two or more frequency channels.

A need remains in the art for a multiband dynamic range compressor which is well behaved for narrow band and broad band signals.

SUMMARY OF THE INVENTION

An object of the present invention is to provide a multiband dynamic range compressor (also called a continuous frequency multiband compressor) which is well behaved for narrow band and broad band signals. The present invention is a new type of multiband compressor called a continuous frequency compressor which is well behaved for both wide band and narrow band signals, and shows no undesirable artifacts at filter crossover frequencies.

The continuous frequency multiband compressor of the present invention includes an improved filter bank comprising a plurality of filters having sufficiently overlapped frequency bands to reduce the ripple in the frequency response given a slowly swept sine wave to below about 2 dB, and down to arbitrarily low sub dB levels depending on amount of overlap.

The invention is an improved multiband audio compressor of the type having a filter bank including a plurality of filters for filtering an audio signal, wherein the filters filter the audio signal into a plurality of frequency bands, and further including a plurality of power estimators for estimating the power in each frequency band and generating a power signal for each band, and further including a plurality of gain calculators for calculating a gain to be applied to each band based upon the power signal associated with each band, and further including means for applying each gain to its associated band and for summing the gain-applied bands, wherein the improvement includes an improved, heavily overlapped, filter bank comprising a plurality of filters, the filters having sufficiently overlapped frequency bands to reduce the ripple in the frequency response, given a slowly swept sine wave input signal, to less than half the dB's of a conventionally overlapped filter bank.

As an example, when the compression ratio of the filter bank is at least about 4, the ripple is below about 2 dB. When the compression ratio is between 1.5 and 4, the ripple is reduced to below about 1 dB.

The filter bank may be implemented as a Short Time Fourier Transform system wherein the narrow bins of the Fourier transform are grouped into overlapping sets to form the channels of the filter bank. Alternatively, the filter bank may be implemented as an IIR filter bank, an FIR filter bank, or a wavelet filter bank.

The invention may be used in a digital hearing aid, as part of the digital signal processing portion of the hearing aid.

FIGS. A1 through A7 provide graphical illustration of the mathematical principles illustrated in the appendix.

DETAILED DESCRIPTION OF THE PREFERRED EMBODIMENT

Figure 4:
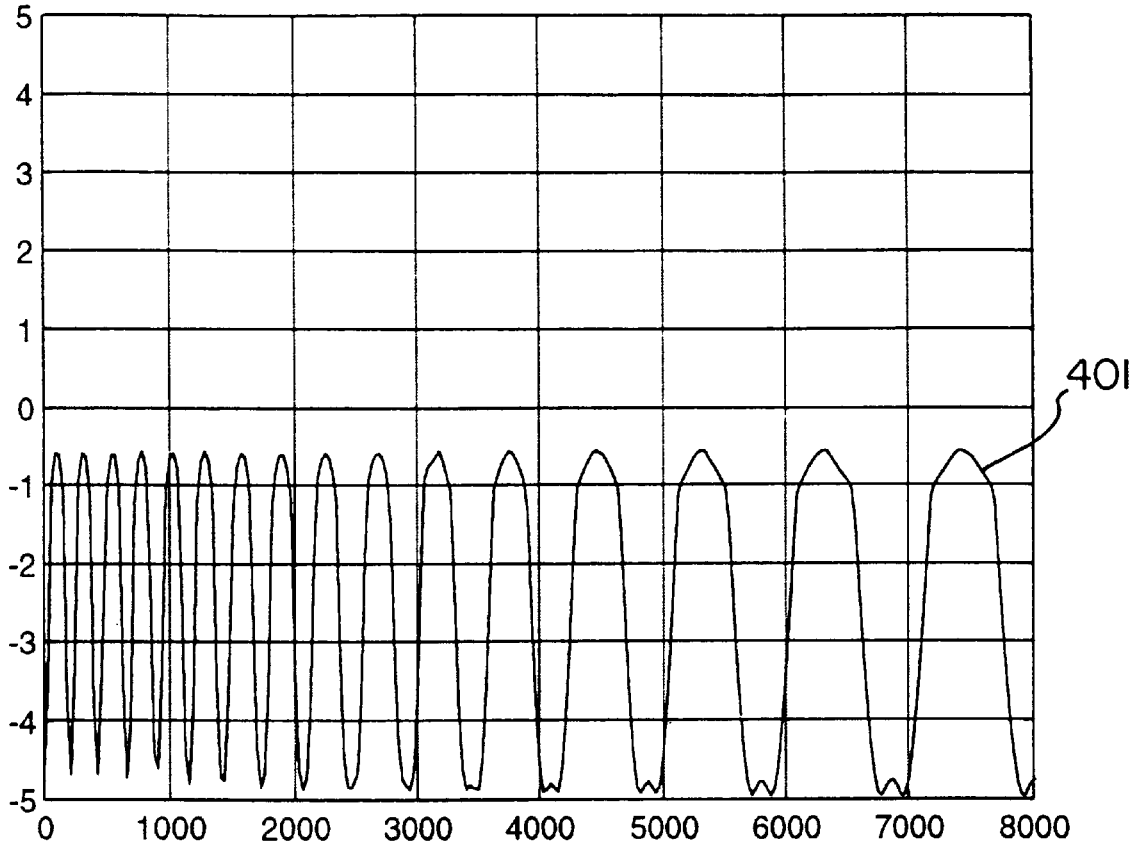
FIG. 4 shows the performance of the conventional compressor of FIG. 2, given a narrow band swept input signal.
Figure 6:
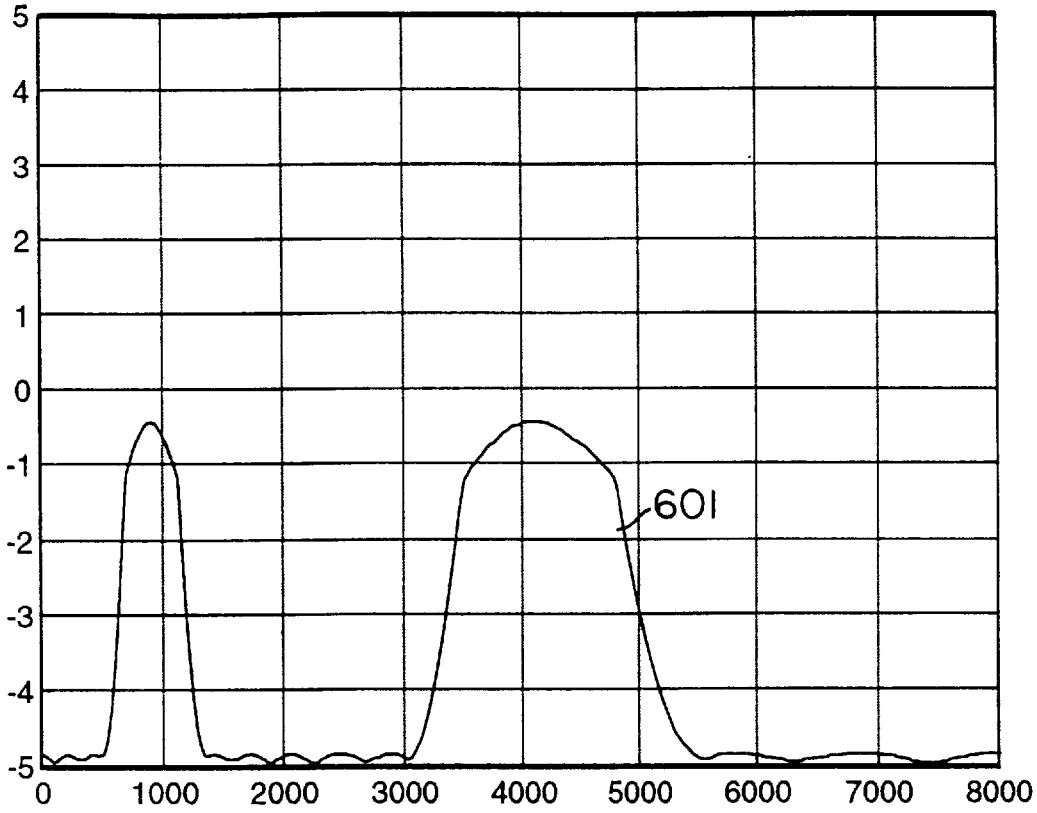
FIG. 6 shows the performance of the conventional compressor of FIG. 5, given a narrow band swept input signal.

The attached Appendix presents a detailed mathematical analysis of the frequency response to narrow band input signals in conventional multiband compressors. This analysis was used to find a solution to the problem shown in FIGS. 4 and 6, wherein conventionally overlapped filter banks produce a large ripple in the frequency response to a narrow band signal, such as a swept sine wave. The solution involves increasing the amount of overlap between band pass filters by a considerable amount. The precise amount of overlap required is a function of the bandwidth and sharpness of the transition bands of the band pass filters.

Figure 7:
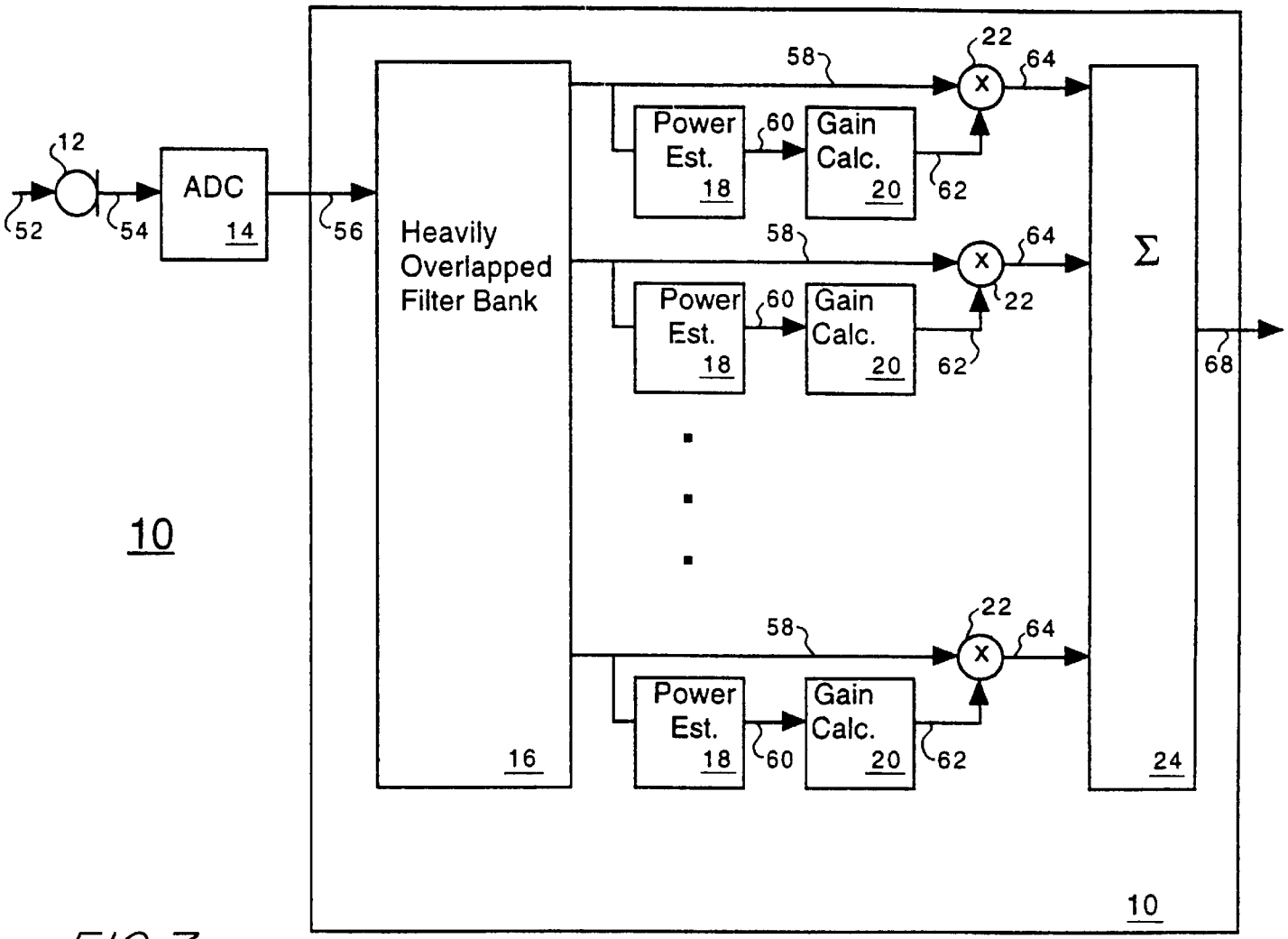
FIG. 7 shows a block diagram of a multiband dynamic range compressor having heavily overlapped band pass filters according to the present invention.

FIGS. 7 through 11 illustrate the effects of increasing filter band overlap. FIG. 7 shows an improved multiband dynamic range compression device (or continuous frequency dynamic range audio compressor) 10 according to the present invention. An audio input signal 52 enters microphone 12, which generates input signal 54. In the preferred embodiment, signal 54 is converted to a digital signal by analog to digital converter 15, which outputs digital signal 56. This invention could be implemented with analog elements as an alternative. Digital signal 56 is received by filter bank 16, which is the heart of the present invention. In the preferred embodiment the filter bank is implemented as a Short Time Fourier Transform system, where the narrow bins of the Fourier Transform are grouped into overlapping sets to form the channels of the filter bank. However, a number of techniques for constructing filter banks including Wavelets, FIR filter banks, and IIR filter banks, are well documented in the literature and it would be obvious to one skilled in the art that any of the techniques could be used as the foundation for filter bank design in this invention.

Filter bank 16 filters signal 56 into a large number of heavily overlapping bands 58. The theory behind the selection of the number of frequency bands and their overlap is given in detail in the Appendix at the end of this section.

Each band 58 is fed into a power estimation block 18, which integrates the power of the band and generates a power signal 60. Each power signal 60 is passed to a dynamic range compression gain calculation block, which calculates a gain 62 based upon the power signal 60 according to a predetermined function. Power estimation blocks 18 and gain calculation blocks 20 are conventional and well known in the art.

Multipliers 22 multiply each band 58 by its respective gain 62 in order to generate scaled bands 64. Scaled bands 64 are summed in adder 24 to generate output signal 68. Output signal 68 may be provided to a receiver in a hearing aid (not shown) or may be further processed.

Figure 5:
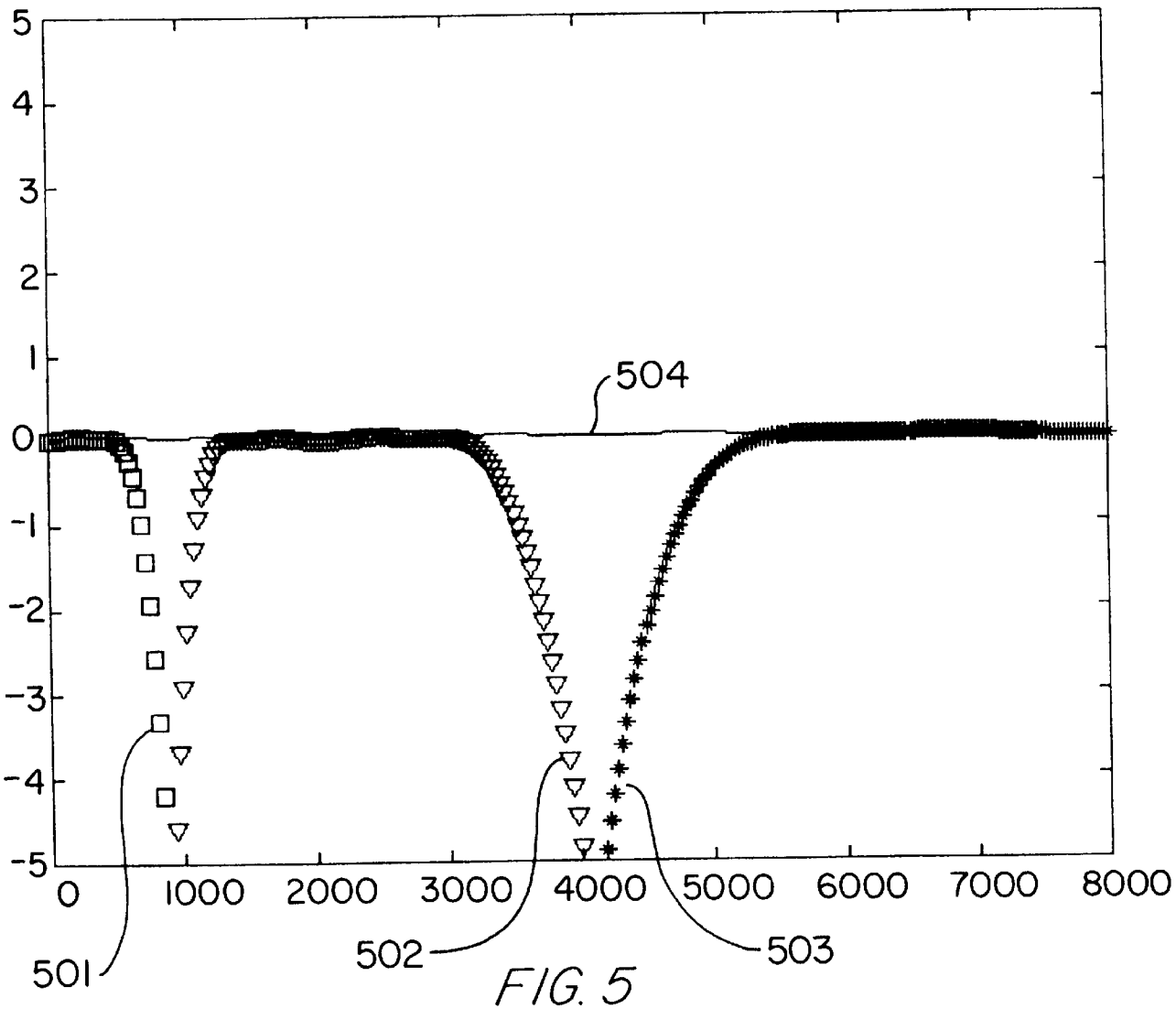
FIG. 5 (prior art) shows the filter bank structure and the performance of an embodiment of the conventional compressor of FIG. 1, having three filters, given a broadband input signal.
Figure 8:
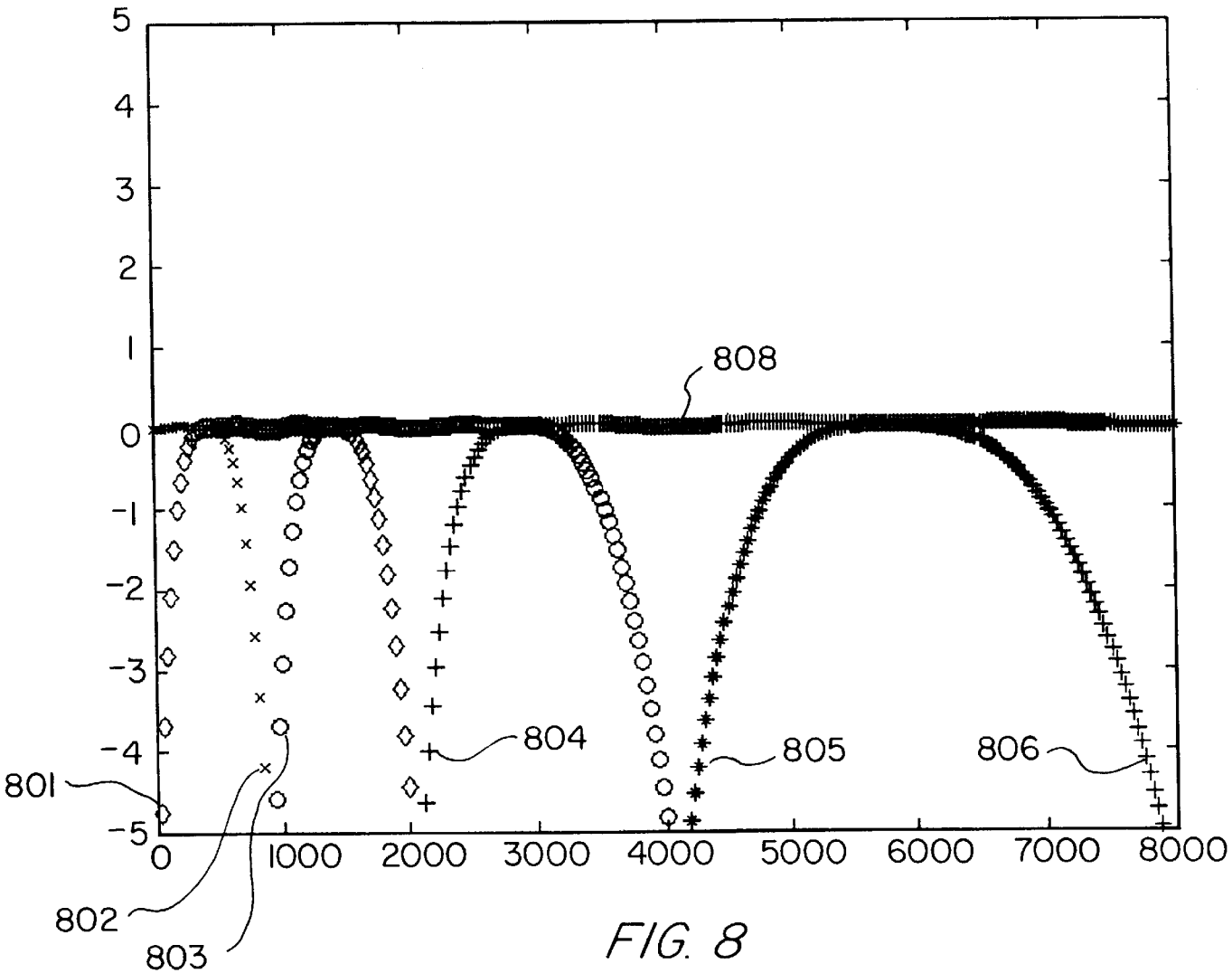
FIG. 8 shows the filter bank structure and the performance of an embodiment of the compressor of FIG. 7, having a somewhat overlapped filters, given a broadband input signal.

FIG. 8 shows the filter bank structure and the performance of an embodiment of the compressor of FIG. 7, having a somewhat overlapped filters, given a broadband input signal. In FIG. 8, the number of filter bands has been increased over the number in the FIG. 5 configuration, to five filters 801–805. The bandwidths of the filters have not changed, so the filters are significantly more overlapped than the FIG. 5 configuration. In other words, the original filters of FIG. 5 are still as they were, and there is a new set of filters interleaved with the originals, resulting in considerably more overlap between adjacent filters. Filter 801 is plotted with diamonds, filter 802 is plotted with x's, filter 803 is plotted with circles, filter 804 is plotted with pluses, and filter 805 is plotted with asterisks.

Figure 9:
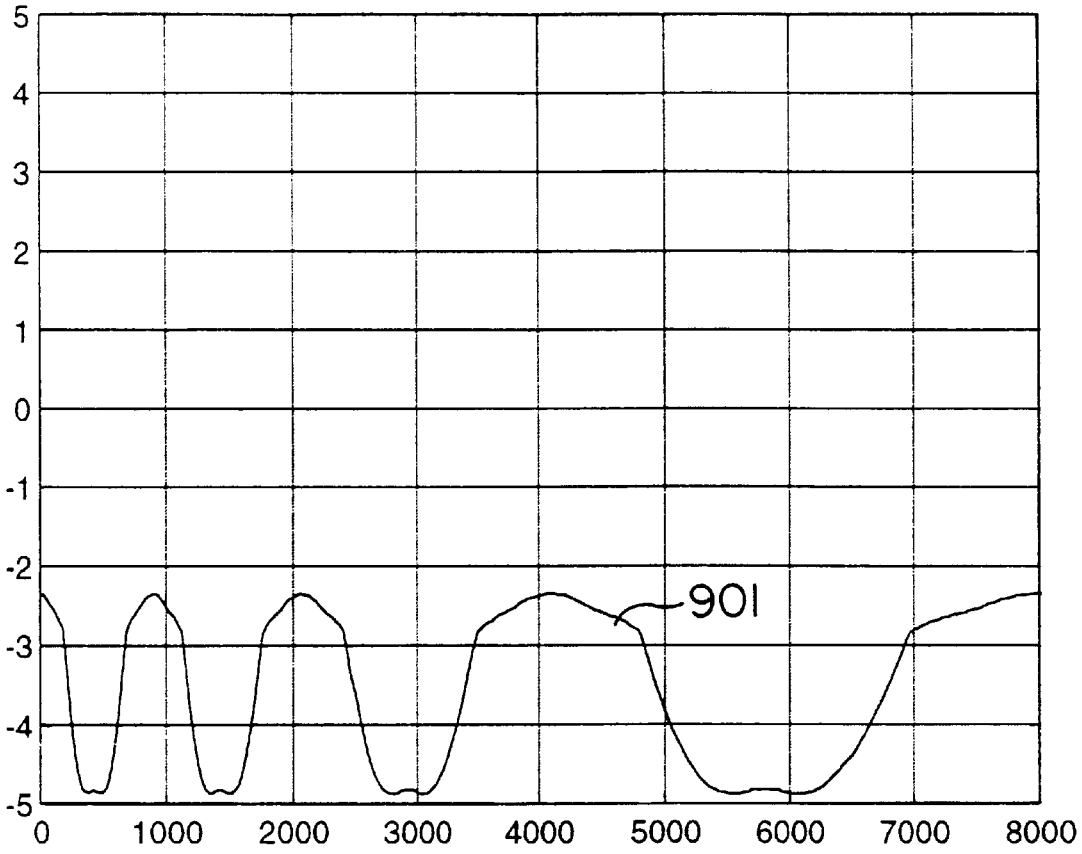
FIG. 9 shows the performance of the embodiment of FIG. 8, given a narrow band swept input signal.

In FIG. 9 we see the swept sine response 901 of the 4 to 1 compressor for the more overlapped filter set of FIG. 8. The ripple has been reduced from 4.5 dB to approximately 2 dB. If the FIG. 8 configuration used a compression ratio of 1.5, the ripple would be reduced from around 2 dB to less than 1 dB.

Figure 10:
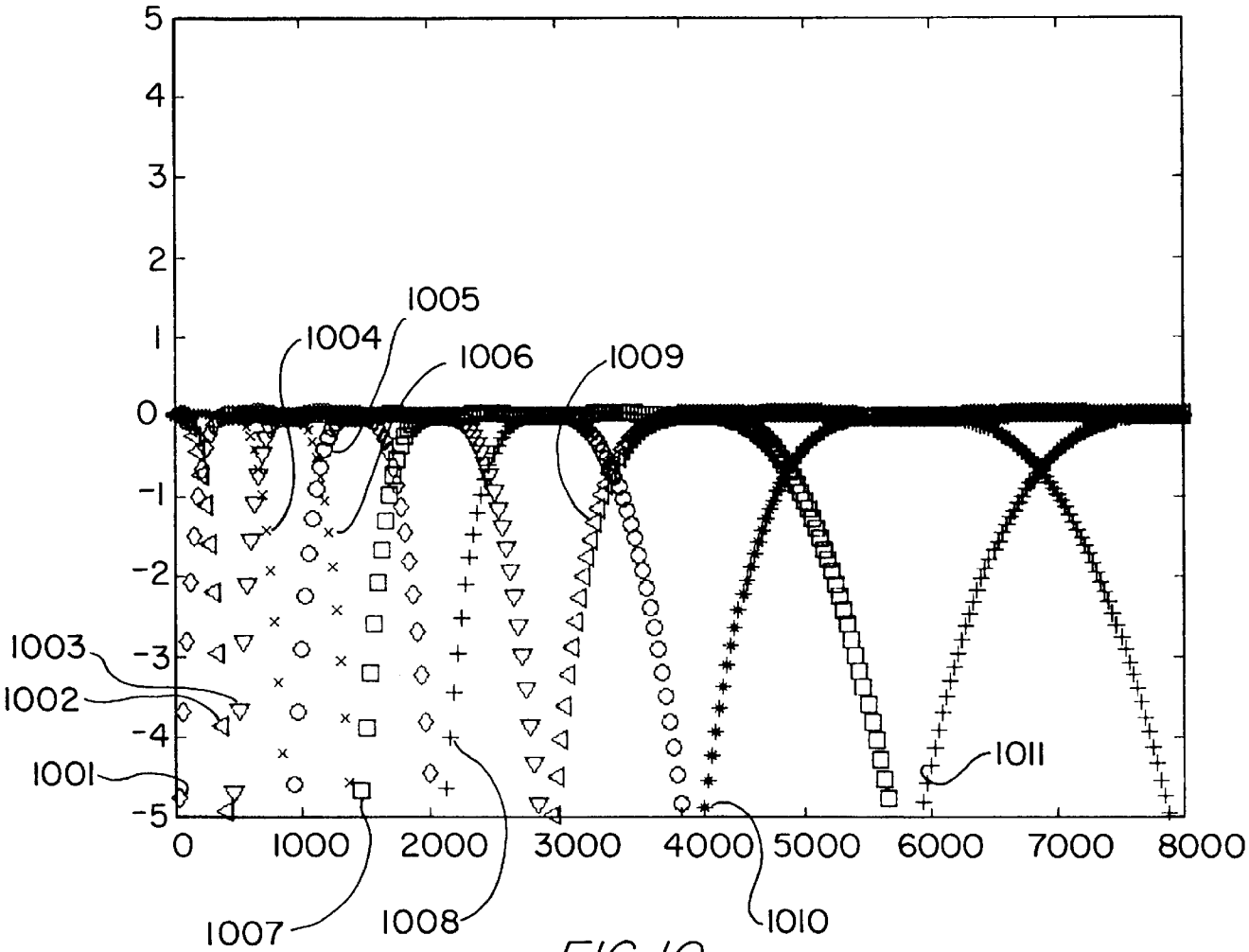
FIG. 10 shows the filter bank structure and the performance of an embodiment of the compressor of FIG. 7, having heavily overlapped filters, given a broadband input signal.

In FIG. 10 we have increased the number of filters over the FIG. 5 and FIG. 8 configurations, to eleven filters, still without changing the filter bandwidths. Filter 1001 is plotted with diamonds. Filter 1002 is plotted with left-pointing triangles. Filter 1003 is plotted with down-pointing triangles. Filter 1004 is plotted with x's. Filter 1005 is plotted with circles. Filter 1006 is plotted with x's again. Filter 1007 is plotted with squares. Filter 1008 is plotted with pluses. Filter 1009 is plotted with left-pointing triangles again. Filter 1010 is plotted with asterisks. Filter 1011 is plotted with pluses again.

Figure 11:
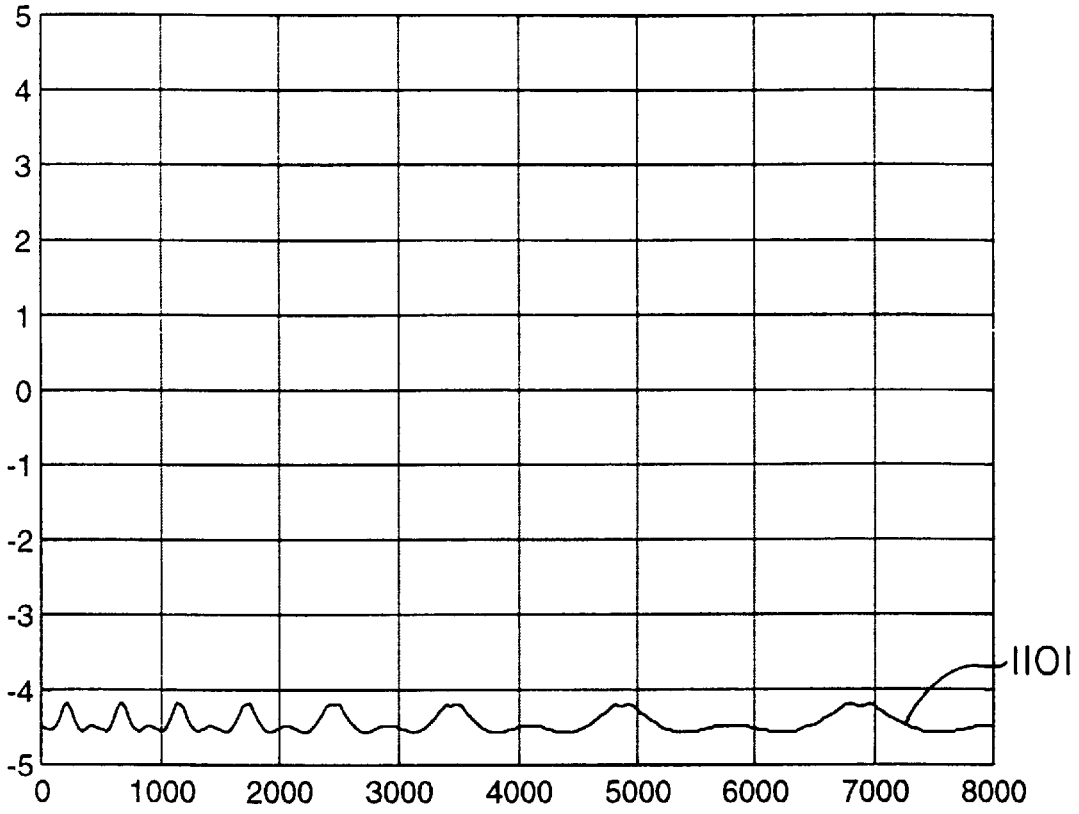
FIG. 11 shows the performance of the embodiment of FIG. 10, given a narrow band swept input signal.

FIG. 11 shows the swept sine response 1101 of the compressor configuration of FIG. 10. We see that the ripple has been reduced to less than one half dB for the 4 to 1 compressor. In the case of a compression ratio of 1.5, the ripple would be reduced to less than one quarter of a dB.

Figure 12:
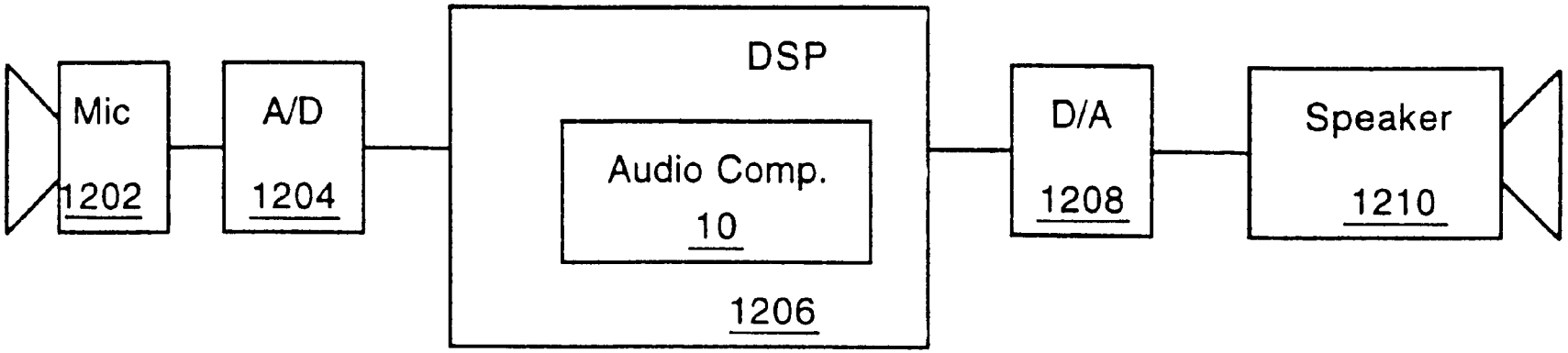
FIG. 12 shows a digital hearing aid which utilizes the multiband dynamic range compressor having heavily overlapped band pass filters of FIG. 7.

FIG. 12 shows a digital hearing aid which utilizes the continuous frequency dynamic range audio compressor 10 having heavily overlapped filter bank 16 of FIG. 7. The hearing aid of FIG. 12 includes a microphone 1202 for detecting sounds and converting them into analog electrical signals. Analog to digital (A/D) converter 1204 converts these analog electrical signals into digital signals. A digital signal processor (DSP) 1206 may accomplish various types of processing on the digital signals. It includes audio compressor 10 having heavily overlapped filter bank 16, as shown in FIG. 7. The processed digital signals from DSP 1206 are converted to analog form by digital to analog (D/A) converter 1208, and delivered to the hearing aid wearer as sound signals by speaker 1210.

In the Appendix we analyze in depth the reasons for the dramatic reduction in ripple with increase in filter overlap. We will briefly summarize these reasons here. We can think of calculating the gain for a multiband compressor as kind of black box filter, which takes as input the power spectrum of the input signal and generates as output a frequency dependent gain. We can think of the input and output of this black box as continuous functions of frequency. Inside the black box we estimate power in a number of discrete frequency bands. In other words, we reduce the continuous power spectrum to a number of sampled points. We then calculate a gain value corresponding to each one of these discrete power spectrum samples, resulting in a discrete set of gain points. Since we must apply gain to every frequency, we interpolate these discrete gain values over the entire frequency range to generate the continuous gain function. This gain interpolation is implicit in the process of applying gain to the output of band pass filters and summing these outputs.

This interpretation of multiband compression in terms of sampling the power spectrum and interpolating gain gives us insight into the problems of narrow band response. We know that when we sample a time domain function we must first band limit the function in frequency to one half the sampling frequency. Since we are sampling the power spectrum in the frequency domain, it is reasonable to assume that we must first limit the time domain representation of the frequency domain power spectrum. This is exactly the dual of limiting the frequency domain bandwidth of a time domain function before sampling.

When we band limit the frequency response of a time domain function we convolve the function in the time domain with the impulse response of a low pass filter. When we time limit the power spectrum we convolve it in the frequency domain with the impulse response of a low pass filter. When we sample the power spectrum, by measuring power at the output of a band pass filter, we are effectively integrating the power spectrum over frequency but first multiplying or windowing the power spectrum with the magnitude squared frequency response of the band pass filter. When we repeat the operation for the next frequency band, it as if we are moving the band pass window in the frequency domain to a new center point and repeating the integration operation. This act of placing a window on the power spectrum, integrating, then moving the window, integrating again, and so on, is, in fact, convolving the power spectrum in the frequency domain by the band pass window and sampling the result of this convolution. It is the same thing as low pass filtering before sampling.

The fact that we vary the width and displacement of the band pass window as we move it across the power spectrum because we use band pass filters with quasi-logarithmic spacing, means that we are continually changing the sample rate and low pass filter response of our sampling system. Nevertheless, the rules of sampling still apply.

In the Appendix we show that the frequency domain sampling interval, that is the band spacing of the band pass filters in Hz, should be less than or equal to one divided by the length in samples of the inverse transform of the magnitude squared frequency response of the band pass filter. This is the same as one divided by the autocorrelation of the band pass impulse response. The impulse response naturally reduces in magnitude towards its extremities and so does its autocorrelation. The length of the autocorrelation is the length comprising all values above some arbitrary minimum values—e.g. 60 dB down from the peak value. This shows that the band pass filter frequency response determines the number of bands required to eliminate narrow band ripple in the compression system.

If this criterion is strictly obeyed the resulting ripple in narrow band response can, in theory, be completely eliminated. In practice we do not need to completely eliminate this ripple so we can compromise. Nevertheless, as we have seen with a typical three band filter bank in FIG. 5, it is not until we increase the number of bands greatly—to eleven bands—without changing the bandwidths of the filters, that we reduce the ripple to sub dB levels as shown in FIG. 10.

Figure 1:
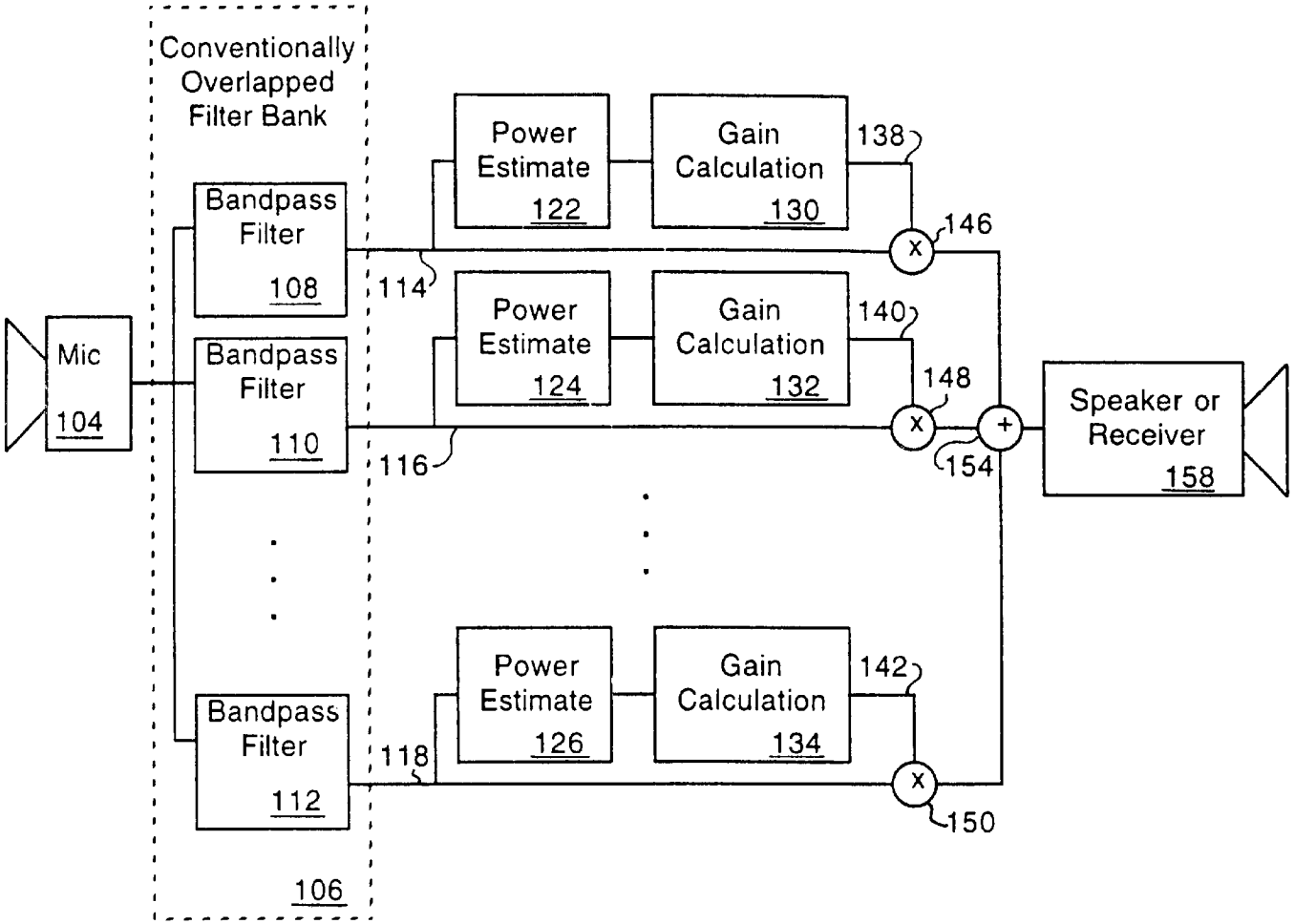
FIG. 1 (PRIOR ART)
FIG. 1 (prior art) shows a block diagram of a prior art multiband dynamic range compressor having conventionally overlapped band pass filters.
Figure 2:
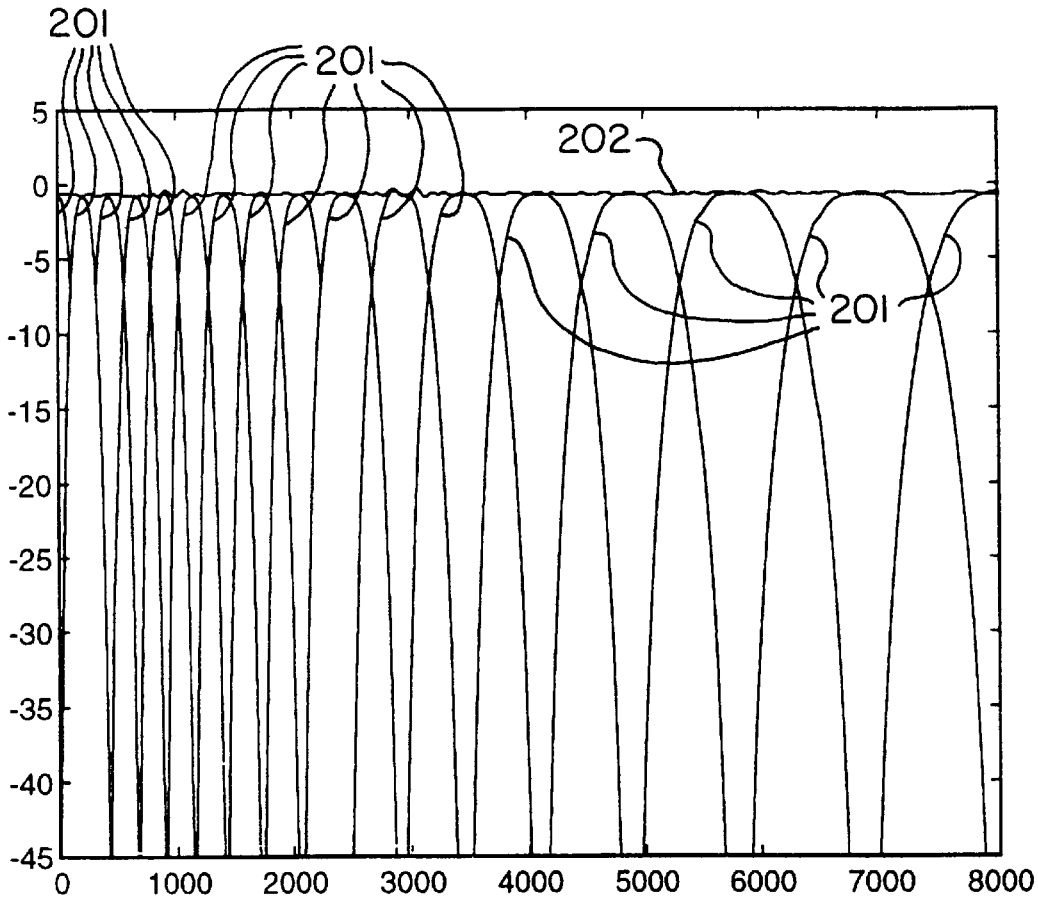
FIG. 2 (prior art) shows the filter bank structure and the performance (or magnitude frequency response of the sum of frequency channels) of an embodiment of the conventional compressor of FIG. 1, having a large number of conventionally overlapped filters.
Figure 3:
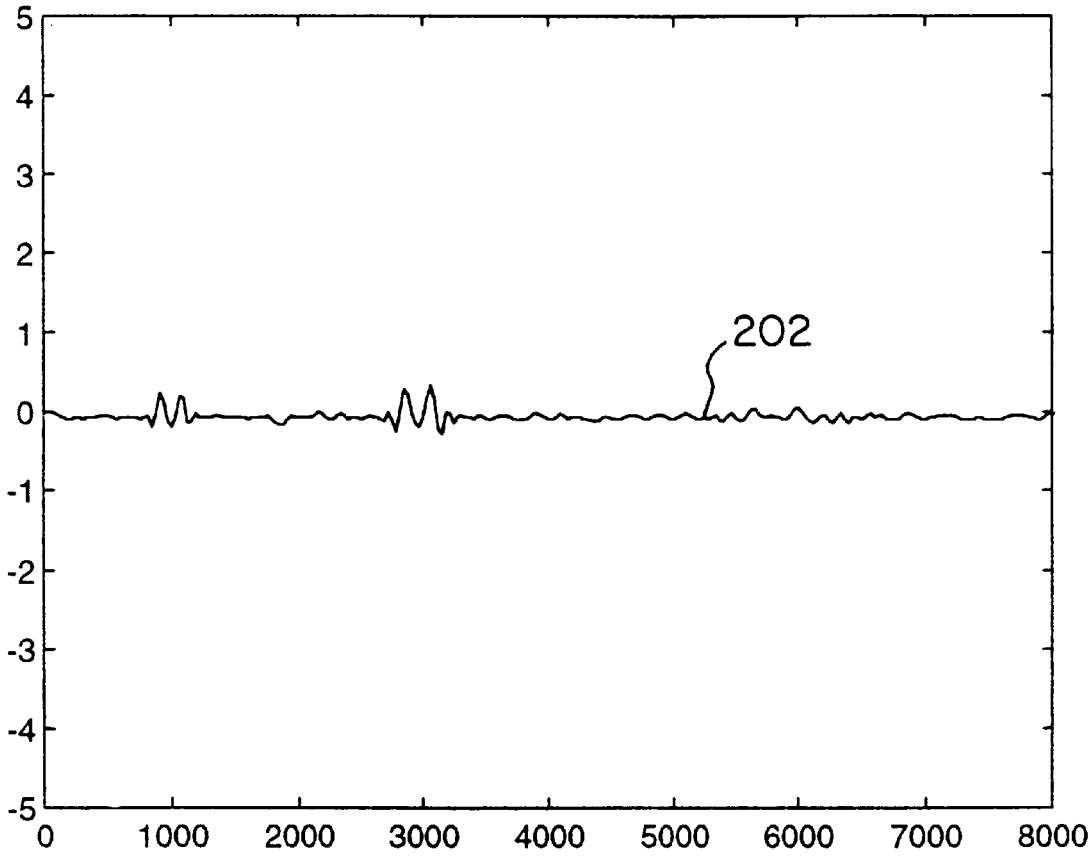
FIG. 3 shows the broadband performance of the conventional compressor of FIG. 2 at a higher resolution than FIG. 2.

Thus, starting with a conventional filter bank whose band pass responses sum to a constant with conventional overlap between band pass filters, we must increase the number of bands by a factor of about three to guarantee sufficiently low ripple for narrow band stimuli. If f(k) for k=1 . . . N are the −6 dB crossover frequency points of a set of band pass filters in a filter bank such as shown in FIGS. 2 and 5, then we define a conventionally overlapped filter bank as one in which each band pass filter, with −6 dB crossover point at f(k), reaches its stopband attenuation at or before f(k+1).

We have defined the criterion for reducing narrow band ripple in a multiband compression system in terms of sampling theory applied to the input power spectrum. When we correctly sample a band limited continuous time domain signal we say that there is no loss of information because we can reconstruct the continuous time domain signal from its samples. What's more, any linear filtering which we perform on the sampled signal will appear as linear filtering of the continuous reconstructed signal. Therefore we do not see the effect of sample boundaries in the output signal and can think of the system as the implementation of a continuous time filter.

Similarly, when we correctly time limit and sample the continuous power spectrum in a multiband compression system we do not see the effect of band edges in the compressed signal and can think of the system as a system which is continuous in frequency. It is a continuous frequency compressor.

While the exemplary preferred embodiments of the present invention are described herein with particularity, those skilled in the art will appreciate various changes, additions, and applications other than those specifically mentioned, which are within the spirit of this invention.

Appendix

*INTRODUCTION*

This Appendix describes the theoretic basis of the present invention. First, some background into conventional multiband audio compressors, and their problems with narrow band input signals, is given in Section 1-4. Then, a new approach, which eliminates the problems with narrow band input signals, is described in Sections 5-11.

The typical (conventional) multiband audio compressor (TMC) consists of a filter bank which divides the input signal into subbands, a power estimator which estimates power in each subband, a compression gain function which generates a time varying gain for each subband based on the power in that subband, and a mixer which applies the subband gain to each subband and sums the subbands to generator the compressor output. Realizable filter banks have finite overlapping transition bands. When a narrow band signal (e.g. sinusoid) is presented near the transition bands the power estimate in each band is lower then for the same narrow band signal in the center of the band. The gain in each band is increased because of the lower power estimate. For a swept sinusoid the result is a bump in the system magnitude response near the transition band. For a wide band input no such bump appears.

This Appendix demonstrates that the division of the power spectrum into subbands can be analyzed as a filtering and sampling function in the frequency domain. The frequency domain sampling interval must be high enough to avoid time-aliasing. The narrow band bump is eliminated when the sampling rate is increased according to this analysis.

TABLE OF CONTENTS FOR APPENDIX

1. STEADY STATE MAGNITUDE FREQUENCY RESPONSE OF TYPICAL MULTIBAND COMPRESSOR (TMC) . . . . . 2

2. COMPRESSION RATIO . . . . . 2

3. EXAMPLE: SIMPLE TWO BAND TMC . . . . . 3

4. MULTIBAND COMPRESSOR AS FREQUENCY DOMAIN SAMPLING SYSTEM . . 7

5. REAL AND COMPLEX SIGNALS . . . . . 10

6. SINUSOIDAL RESPONSE . . . . . 10

7. TWO BAND TMC IN LIGHT OF FREQUENCY DOMAIN SAMPLING CRITIREA 11

8. SHIFT INVARIANCE . . . . . 13

9. EXTENSION TO LOGARITHMICALLY SPACED BANDS . . . . . 13

10. CONCLUSION . . . . . 13

11. APPENDIX A : MATLAB SIMULATION OF SINUSOIDAL RESPONSE . . . . . 14

1. STEADY STATE MAGNITUDE FREQUENCY RESPONSE OF TYPICAL MULTIBAND COMPRESSOR (TMC)

The magnitude frequency response of a typical (conventional) multiband audio compressor (TMC) is adaptive: it is a function of the frequency dependent power distribution of the input signal. For a steady state input, the adaptive magnitude response or frequency dependent compression gain of the *bth* channel of the TMC is:

$$G_b(\omega) = H_b(\omega) \bullet f(P_b) \quad (1)$$

where:

$H_b(\omega J)$ is the frequency response of the *bth* fixed bandpass filter of the TMC, and $f(.)$ is the instantaneous memoryless compressive non-linear gain function.

$$P_b = \int_{-\infty}^{\infty} \left| H_b(\omega) \bullet X(\omega) \right|^2 d\omega \quad (2)$$

is the power at the output of the *bth* channel, where:

$X(\omega)$ is the steady state spectrum of input signal.

If $H_b(\omega J)$, for all bands *b*, is linear phase then the composite TMC magnitude response or frequency dependent compression gain is the sum of the individual subband responses:

$$G(\omega) = \sum_{<b>} G_b(\omega) \quad (3)$$

2. COMPRESSION RATIO

When we apply the compression gain $f(P_b)$ to the output of filter $H_b(\omega J)$ the power of the scaled signal is $P_{out}$ and we have:

$$P_{out} = P_b \bullet f(P_b)^2 \quad (4)$$

The compression ratio in band *b* is the ratio of the power measured at the output of filter $H_b(\omega)$ in dB, that is $db(P_b)$, to the power in dB after the compression gain is applied, that is $db(P_{out})$:

$$\text{cratio} = \frac{db(P_b)}{db(P_{out})} \quad (5)$$

where:

$$\ldots\ldots\ldots\ldots\ldots\ldots \quad db(.) = 10 \cdot \log 10\,(.)$$

The *db* change in power due to applying a linear gain *g* is $db(g^2)$ which we refer to as *dB_gain*. Therefore:

$$\ldots\ldots\ldots\ldots \quad db_gain = db(g^2) = 10 \cdot \log 10\,(g^2) = 20 \cdot \log 10(g) \quad (6)$$

and:

$$\ldots\ldots\ldots\ldots\ldots\ldots\ldots\ldots\ldots\ldots\ldots\ldots \quad g = 10^{\frac{db_gain}{20}} \quad (7)$$

Since $f(P_b)$ is the compression gain, then combining (4) ,(5), (6) and some algebraic manipulations gives the expression for *dB_gain*:

$$db\left(f(P_b)^2\right) = db(P_{out}) - db(P_b) = \frac{db(P_b)}{cratio} - db(P_b) = \left(\frac{1}{cratio} - 1\right) \cdot db(P_b)$$

(8)

we have from (7) and (8) the expression for the compression gain function:

$$\ldots\ldots\ldots\ldots \quad f(P_b) = 10^{\left(\frac{1}{cratio} - 1\right) \cdot \frac{db(P_b)}{20}} = \left(10^{10 \cdot \log 10(P_b)}\right)^{\frac{10}{20cratio} \cdot \frac{10}{20}} = P_b^{\left(\frac{1}{2cratio} - \frac{1}{2}\right)}$$

(9)

For example, if $P_b = 16$ so that $db(P_b) \approx 12dB$ and cratio = 4 then we expect $db(P_{out}) = 12/4 = 3db$ or $P_{out} = 2$. From (9) we get $f(P_b) \approx .3536$ and from (4) we have $16 \cdot (.3536)^2 \approx 2$ as desired.

As $P_b \Rightarrow 0$, $f(P_b)$ gets bigger and bigger, but for $P_b = 0$, $f(P_b) = 0$. Apart from this singularity the uncontrolled growth of $f(P_b)$ for small $P_b$ is undesirable for other regions. It amplifies the stop band regions of $H_b(\omega)$ where the frequency response consists of sidelobes which are not at all flat. In addition, in a realistic environment the over amplification of extremely soft ambient and electrical sounds (microphone preamp noise, etc.). makes the compressor sound noisy. For these reasons a low level compression knee is defined so that:

for $P_b >$ KNEE ..... $f(P_b)$ as in (9);

for $P_b \leq$ KNEE ..... $f(P_b) = \text{KNEE}^{\left(\frac{1}{2\,\text{cratio}} - \frac{1}{2}\right)}$ So, the gain is linear for input power less than the compression knee.

3. EXAMPLE: SIMPLE TWO BAND TMC

Consider a two band TMC. The $H_b(\omega J)$ for $b \in [0,1]$ comprise a power symmetric low and high pass FIR pair of 16 taps. The magnitude frequency response of the two filters is shown Figure A1. The sum of the magnitude responses of the low and high pass filters is unity across all frequencies.

The compression gain function is defined as in (9). The compression gain is unity for input power $P_b = 1.0$ and provides cratio compression over all. If input $x(t)$ = Gaussian white noise, band limited to twice the crossover frequency $f_c$ of the two filter bands with input levels adjusted so that $P_b$ in each band is $1.0$, $.5^2$, $.25^2$ for three different input levels and cratio = $2.0$ then the composite $dB_gain = db(G(\omega)^2)$ responses for the three input levels are shown in Figure A2.

We see that as input noise magnitude $\sigma$ is halved (-6db power) the compressor compensates for half the power loss by applying db_Gain of 3 and 6 dB. As expected the composite responses are flat for input white noise.

Since the filters are power complementary and linear phase the sum of the magnitude response of the two filters is unity at all frequencies. This being the case, at the center of the transition bands the magnitude response of each filter is .5. Assume a sinusoidal input with unity power. If the sinusoid appears in the middle of a band then:

$$P_b = P_{out} = 1.0 \Rightarrow 0db$$

Now assume the sinusoid is in the middle of the transition band of the two filter bands. Each band will scale the magnitude by .5 and so:

$$P_b = .5^2 = .25 \Rightarrow -6\text{db}$$

in each band. With cratio = 2.0 the compressor will compensate for half the power loss in db and boost the power to each band to -3db. When the two bands are added together this doubles their magnitudes which increases the total power by four resulting in $$P_{out} = 2.0 \Rightarrow 3\text{db}$$

which is a doubling in power relative to the case when the sinusoid was centered in one filter band.

This can be verified using the formulae described above:

If:

$$P_b = .25$$

because of the magnitude scaling by .5 in each band then (9) :

$$f(P_b) = .25^{\left(\frac{-1}{4}\right)} = \sqrt{2}$$

which from (4) gives:

$$P_{out} = .25 \cdot \sqrt{2}^2 = .5 \text{ per channel.}$$

Adding the magnitudes of the two channels gives:

$$P_{total} = \left(\sqrt{.5} \cdot 2\right)^2 = 2.0$$

as predicted.

There is an undesirable 3db hump in dB_gain at the transition band. Figure A3 shows the composite dB_gain response to a sinusoid at all frequencies with the 3db bump. The smaller bumps near 0 and $\pi$ are due to over amplification of the stop band side lobes since no low level compression knee was used to calculate Figure A3.

4. MULTIBAND COMPRESSOR AS FREQUENCY DOMAIN SAMPLING SYSTEM

A general recipe for analyzing a multiband compressor can be described as follows:

1. Set filter center frequency $f_{CENTER} = 0$.
2. Shift the prototype low pass filter so that it is centered at $f_{CENTER}$ and apply it to the input signal.
3. Integrate the squared output of 2. across frequency to create a power estimate.

4. Calculate compression gain from 3.
5. Apply compression gain to output of 2.
6. Set filter center frequency to $f_{CENTER} = f_{CENTER} + S$, where S is a frequency domain sampling interval. If the filter is still in the audio frequency range of interest then repeat steps 3-6.
7. Sum the output of all filter outputs.

In fact, step 6. above is a bit misleading since in fact the filter center frequency needs to be shifted both in the positive and negative frequency directions to be correct for a real input signal. In the simple two band multiband compressor described in previous sections the frequency domain sampling interval is $\pi$ since in the digital simulation the filters are centered at DC and Nyquist (one half the sample rate) and the band width of the prototype low pass filter $H(\omega)$ is also $\pi$.

As $S \Rightarrow 0$ the repeated operation of shifting the filter and integrating power becomes equivalent to the continuous convolution in the frequency domain of the squared low pass filter response with the input power spectrum. In fact we can view the multiband compressor as sampling at interval S in the frequency domain of this continuous convolution. The sampling results in a frequency domain impulse train where the height of each impulse represents the power estimate for the filter centered around that impulse. The nonlinear gain compression function is applied to this impulse train resulting in an impulse train of gain values. Each gain impulse is used to scale the output of a filter centered around the gain impulse. This operation of using the gain impulse train to scale shifted filters is equivalent to convolving the gain impulse train with a prototype filter in the frequency domain. This view of the multiband compressor can be viewed as a filtering flow graph in which the input is the power spectrum and the output is frequency dependent compression gain as shown in Figure A4.

Once again, the input power spectrum $|X(\omega)|^2$ is convolved in the frequency domain with the magnitude squared response of a prototype low pass filter $|H(-\omega)|^2$. This corresponds to a smoothing of the input power spectrum. The smoothed power spectrum $P(\omega)$ is sampled in the frequency domain at sampling interval S. The discrete sampled spectrum $P_b$ is subject to the compression non-linearity $f(.)$ to form the discrete compression gain impulse train Gb which is convolved in the frequency domain with filter $F(\omega)$ to form the continuous compression gain $G(\omega)$.

The degrees of freedom in this system are: shape and width of the prototype low pass filter $H(\omega)$; frequency domain sampling interval S in Hz; shape of the compression non-linearity $f(.)$; response of the low pass filter $F(\omega)$. In this case we have assumed a uniform filter band width frequency domain sampling interval S. In a useful implementation both would change with frequency so that the band spacing could follow the critical band rate. However, for the sake of simplicity in presenting this model we will continue to assume linear band spacing. The results can then be generalized to arbitrary band spacing. The frequency domain sampling interval S defines the number of compression bands which together with the width and shape of $H(\omega)$ define the amount of overlap between compression bands.

The compression gain function $f(.)$ is a memoryless function. That is for every single input power value it generates a single gain value which depends only on the single input power value. Because of this, the sampling function and the compression gain function in Figure A4 commute and Figure A4 can be rearranged as shown in Figure A5.

In Figure A5, $F(\omega)$ is an interpolation filter which approximately reconstructs $G'(\omega)$ after sampling. $G'(\omega)$ is the ideal compression gain, continuous across frequency. As with any sampling system, $G'(\omega)$ must be band-limited before sampling. Since we are sampling in the frequency domain it is more correct to say $G'(\omega)$ must be *time-limited* to avoid *time aliasing*.

The convolution $|X(\omega)|^2 * |H(\omega)|^2$ corresponds to multiplication in the time domain of the inverse transform of $|X(\omega)|^2$, the autocorrelation function, by the inverse transform of $|H(\omega)|^2$, the autocorrelation of the FIR prototype coefficients. Since the autocorrelation of the FIR is finite this multiplication corresponds to a time limiting or time windowing operation . This is illustrated by the duality:

$$|X(\omega)|^2 * |H(\omega)|^2 \Leftrightarrow r_{xx}(\tau) \cdot r_{hh}(\tau)$$

The non-linearity acts as a time width expander (for example $f(.) = x^2$ doubles the time width).

When the input is white noise the autocorrelation is non-zero over an extremely limited range (ideally an impulse) so time limiting is guaranteed. For a sinusoid or other periodic input with long non-zero autocorrelation (e.g. infinite) the frequency domain sampling interval must equal or exceed the inverse of the time width of the FIR autocorrellation multiplied by the expansion factor due to the non-linearity.

$$S \geq (\mathrm{LENGTH}(r_{hh}(\tau)) \cdot \Psi)^{-1} \quad (10)$$

where:

expansion factor due to non-linearity sampling interval in HZ

Unless these sampling criteria are met time domain aliasing will occur which will result in the kind of narrow band artifact we saw in the case of the 3dB bump for the two band multiband compressor. We will analyze the 2 band multiband compressor case in the light of these sampling criteria but first we will define mathematical expressions for Figure A5.

Figure A5 can be written in functional form as:

$$G'(\omega) = f'\left(\int_{-\infty}^{\infty} |X(\varphi)|^2 \cdot |X(\varphi-\omega)|^2 d\varphi\right) \quad (11)$$

$$G(\omega) = \sum_{b=-\infty}^{\infty} G'(bS) \cdot F(\omega - bS) \quad (12)$$

Where $G'(\omega)$ defines the non-linear compression function of the continuous frequency domain convolution of the input power spectrum with the prototype low pass filter, and $G(\omega)$ is the sum of individual shifted filters $F(\omega - bS)$ weighted by the discrete sampling of $G'(\omega)$ at the filter center frequencies.

Note that in (11) we have flipped the sign of the argument of $H(.)$ relative to conventional convolution notation because for our purposes $H(.)$ refers to a window which must be reversed to be used as an impulse response in a convolution operation.

5. REAL AND COMPLEX SIGNALS

There is still a problem with the analysis of the previous section. First, suppose that the input is a complex exponential of frequency $\phi$ so that the power spectrum $|X(\omega)|^2$ is an impulse at $\omega = \phi$. The smoothed spectrum will look like a shifted version of $|H(\omega)|^2$ centered at $\phi$. No matter where $|H(\omega)|^2$ is centered it will have the same shape and will generate an appropriately frequency shifted version $G(\omega)$. This is appropriate since we want a complex exponential of any frequency to receive the same compression gain (assuming equal weighting of bands) no matter what its frequency.

Now suppose that the input is a real sinusoid of frequency $\phi$ so that the power spectrum $|X(\omega)|^2$ consists of two impulses centered at $\omega = \pm\phi$. The smoothed spectrum will now be the superposition of two shifted copies of $|H(\omega)|^2$. Depending on $\phi$ and the width of $|H(\omega)|^2$ the two shifted copies of $|H(\omega)|^2$ may or may not overlap producing for the lowest frequencies one large hump consisting of the sum of two almost completely overlapping $|H(\omega)|^2$'s and at higher frequency two independent $|H(\omega)|^2$ humps. When the resulting smoothed spectrum is passed through the non-linear function $|H(\omega)|^2$ the compression gain will be different depending on $\phi$. This follows from the fact that the non-linear function does not obey superposition. The function of the sum of two humps does not equal the sum of the function of two humps if the humps are overlapping. The result is we will measure more power near DC than at higher frequencies. Note that this problem persists no matter what the frequency domain sampling interval is.

In general when different complex exponential frequencies are superposed, such as in a complex tone, the non-linearity is not a problem since we do not need or want the compression gain applied to two tones near in frequency to be the same as two tones distant in frequency.

One way to deal with this problem is to perform power analysis on the spectrum of the Hilbert transform of the input signal so that there are is energy only at positive or negative frequencies but not both. This way there is no problem of superposition. We will assume this approach for the remainder of this paper.

6. SINUSOIDAL RESPONSE

Since we are assuming compression gain calculation based on the Hilbert transform of the input signal then this section will deal with response to a complex exponential . As mentioned above, the input power spectrum $|X(\omega)|^2$ is an impulse at $\omega = \phi$. We will assume, for simplicity, that the magnitude of this impulse is unity, so that using (11) we find the compression gain for the filter centered at bS:

$$G'_{sin}(bS) = f\left(|H(\phi - bS)|^2\right) \quad (13)$$

then, the composite compression gain at $\omega = \phi$ is the sum of the response of various shifted filters $F(\omega - bS)$ at $\omega = \phi$ with each filter weighted by the corresponding $G'_{sin}(bS)$ compression gain value:

$$G_{sin}(\phi) = \sum_{b=-\infty}^{\infty} G'_{sin}(bS) \cdot F(\phi - bS) \quad (14)$$

For a complex exponential we are only concerned with the compression gain at $\omega = \phi$ since there is no input energy elsewhere. We can now plot $G_{sin}(\phi)$ for varying $\phi$. This is similar to the swept tone response of the system.

7. TWO BAND TMC IN LIGHT OF FREQUENCY DOMAIN SAMPLING CRITIREA

In the two band TMC described above, the sampling interval is the corner frequency of $H_0(\omega)$, the prototype low pass filter band shown in Figure A1. It is interesting to determine whether S is sufficiently small to account for the time-width of the inverse transform of $|H(\omega)|^2$, that is $r_{hh}(\tau)$. In $h(t) = IFT(H_0(\omega))$ is approximated by $h(n)$, a 16 tap dicrete time FIR filter. We have:

$$\ldots\ldots\ldots\ldots\ldots\ldots\ldots\ldots\ldots\ldots\ldots\ldots S_{TMC_2BAND} = \frac{2 \cdot \pi}{2}$$

where $2 \cdot \pi$ = sample_rate. In principle, the length of $r_{hh}(n)$ is $2 \cdot 16 - 1 = 31$ samples. This leads to:

$$\ldots\ldots\ldots\ldots\ldots\ldots\ldots\ldots S_{CORRECT} = \frac{1}{\text{length}(r_{hh}(n))} = \frac{2 \cdot \pi}{31}$$

We see that choosing $S = \pi$ would appear to be 15.5 times larger than required to avoid time-aliasing. However, in Figure A6 we plot $r_{hh}(n)$, and see that it falls off rapidly at about 10 samples from the midpoint, so as a time window, its effective length may be closer to 20 samples, leading to $$S_{GOOD} = \frac{2 \cdot \pi}{20}$$

This still requires S one tenth the size of the original TMC system. As we shall see in simulation, however, S can be still larger than this since the system is relatively tolerant of a certain amount time-aliasing.

Using a discrete approximation of (14) we calculate $db\left(\left|G_{SIN}(\phi)\right|^2\right)$ for varying S given the 16 tap low pass FIR $H_0(\omega)$ described above. This is displayed in Figure A7 for a compression ratio of 4 to 1.

$S = 2\pi/2$ is the original two band TMC sampling interval which corresponds to a 2 band compressor. $S = 2\pi/4$ has four bands between 0 and $2\pi$ but this corresponds to 3 real compression bands. Likewise, $S = 2\pi/8$ corresponds to 5 real compression bands.

8. SHIFT INVARIANCE

For a complex exponential, Figure A5 behaves as a linear system if properly sampled. It therefore exhibits shift invariance and the compression gain is independent of the frequency of the complex exponential. While not linear because of $f(.)$ the system still obeys shift invariance for a given cluster of complex exponentials of positive frequency. For real signals there will be a variation in compression gain for tones near DC as described above.

9. EXTENSION TO LOGARITHMICALLY SPACED BANDS

The sampling interval S depends on bandwidth and shape of $H(\omega)$. If we vary this bandwidth and shape, e.g. by varying according to the critical band rate, then we must vary S accordingly. Other than this the system behaves as described above.

10. CONCLUSION

We have shown that to have a well behaved multiband compressor it is not enough to define a power symmetric or perfect reconstruction filter bank. Narrow band anomalies, such as the compression gain *3db* bump still occur in transition bands. By viewing the compression gain calculation as a frequency domain sampling problem, and by decreasing the frequency domain sampling interval we can eliminate the *3db* bump.

The frequency domain sampling interval depends largely on length of the autocorrelation of the prototype low pass filter coefficients, which, in turn, depends on band width and steepness of transition bands of the prototype low pass filter frequency response. In general we need more overlap between adjacent bands then we might otherwise have thought. This is in keeping with our view of the behavior of the Cochlear compressor which uses a filter bank with essential continuous overlap.

MATLAB SIMULATION OF SINUSOIDAL RESPONSE

```
figure(1); clf;
hold off;

% frequency domain sampling interval = 2*pi/M
for M = [2 4 8]

% filters
TAPS = 15; % must be odd for highpass fir1
% number of filters
%M = 4;
N = 1024;

f=zeros(M,TAPS); % array of FIR filter coefs sets
h=zeros(N,M); % array of frequency responses
g=zeros(size(h)); % array of compression gains
r=zeros(size(h)); % array of sinusoidal responses

f(1,:) = fir1(TAPS-1,.5);  % prototype low pass
[h(:,1),fax] = freqz(f(1,:),1,N,'whole');

% other filters are complex modulations of original
for k=2:M,
```

```
f(k,:) =
f(1,:).*exp(j*2*pi*(k-1)/M*(-floor(TAPS/2):floor(TAPS/2)));
h(:,k) = freqz(f(k,:),1,N,'whole');
end

%h = h.*1/sqrt(2);
% h = variance=2.0 sinusoid response

% complex exponential compression response for each band at the exponential
frequency
% compression gain = f(|h|) = |h|^(1/cratio-1) for |h| > knee =
knee^(1/cratio-1) fro |h| < knee
% magnitude response = f(|h|)*|h|

cratio = 2.0;
knee = -35;
gknee = (10^(knee/20)).^(1/cratio-1);
ix = find(db(h)>knee);
g(ix) = abs(h(ix)).^(1/cratio-1);
ix = find(db(h)<=knee);
g(ix) = zeros(size(ix))+gknee;
r = (h.*g).*2/M;
m = sum(r.').';
%plot(fax(1:N/2),db(r(1:N/2)),fax(1:N/2),db(m(1:N/2))); axis([0 pi
0 5]); grid;
```

```
plot(fax(1:N/2),db(m(1:N/2)));   axis([0 pi -5 5]); grid;
hold on;
end
hold off;
```

We claim:

1. An improved multiband audio compressor of the type having a filter bank including a plurality of filters for filtering an audio signal, wherein said filters filter the audio signal into a plurality of frequency bands, and further including a plurality of power estimators for estimating the power in each frequency band and generating a power signal for each band, and further including a plurality of gain calculators for calculating a gain to be applied to each frequency band based upon the power signal associated with each frequency band, and further including means for applying each gain to its associated band and for summing the gain-applied bands, wherein the improvement includes an improved, heavily overlapped, filter bank comprising:

a plurality of filters, said filters having sufficiently heavily overlapped frequency bands to reduce the ripple in the frequency response of the filter bank, given a slowly swept sine wave input signal, to to below 2 dB.

2. The apparatus of claim 1 wherein the compression ratio of said filter bank is at least about 4.

3. The apparatus of claim 2 wherein said filter bank is implemented as a Short Time Fourier Transform system wherein the narrow bins of the Fourier transform are grouped into overlapping sets to form the channels of the filter bank.

4. The apparatus of claim 2 wherein said filter bank is implemented as an IIR filter bank.

5. The apparatus of claim 2 wherein said filter bank is implemented as an FIR filter bank.

6. The apparatus of claim 2 wherein said filter bank is implemented as a wavelet filter bank.

7. The apparatus of claim 1 wherein the compression ratio of said filter bank is at between about 1.5 and about 4 and the ripple is below about 1 dB.

8. The apparatus of claim 7 wherein said filter bank is implemented as a Short Time Fourier Transform system wherein the narrow bins of the Fourier transform are grouped into overlapping sets to form the channels of the filter bank.

9. The apparatus of claim 7 wherein said filter bank is implemented as an IIR filter bank.

10. The apparatus of claim 7 wherein said filter bank is implemented as an FIR filter bank.

11. The apparatus of claim 7 wherein said filter bank is implemented as a wavelet filter bank.

12. A continuous frequency dynamic range compressor comprising:

a filter bank including a plurality of filters for filtering an input signal into a plurality of frequency bands;

a plurality of power estimators, each power estimator connected to a filter, each power estimator for estimating the power in the frequency band of its associated filter and generating a power signal related to the power in the frequency band of its associated filter;

a plurality of gain calculators, each gain calculator connected to a power estimator, each gain calculator for calculating a gain related to the power estimated by its associated power estimator;

a plurality of gain applying means, each gain applying means connected to a gain calculator, each gain applying means for applying the gain calculated by its associated gain calculator to the frequency band associated with its associated gain calculator; and means for summing the gain-applied frequency bands;

wherein said filters filter the input signal into sufficiently heavily overlapped frequency bands to reduce the ripple in the frequency response, given a slowly swept sine wave input signal and a compression ratio of at least about 4, to below about 2 dB.

13. The continuous frequency dynamic range compressor of claim 12, wherein said filters filter the input signal into sufficiently heavily overlapped frequency bands to reduce the ripple in the frequency response, given a slowly swept sine wave input signal, to below about 1 dB.

14. The continuous frequency dynamic range compressor of claim 13, wherein said filters filter the input signal into sufficiently heavily overlapped frequency bands to reduce the ripple in the frequency response, given a slowly swept sine wave input signal, to below about 0.5 dB.

15. A continuous frequency dynamic range compressor comprising:

a filter bank including a plurality of filters for filtering an input signal into a plurality of frequency bands;

a plurality of power estimators, each power estimator connected to a filter, each power estimator for estimating the power in the frequency band of its associated filter and generating a power signal related to the power in the frequency band of its associated filter;

a plurality of gain calculators, each gain calculator connected to a power estimator, each gain calculator for calculating a gain related to the power estimated by its associated power estimator;

a plurality of gain applying means, each gain applying means connected to a gain calculator, each gain applying means for applying the gain calculated by its associated gain calculator to the frequency band associated with its associated gain calculator; and means for summing the gain-applied frequency bands;

wherein said filters filter the input signal into sufficiently heavily overlapped frequency bands to reduce the ripple in the frequency response, given a slowly swept sine wave input signal and a compression ratio of between about 1.5 and about 4, to below about 1 dB.

16. The continuous frequency dynamic range compressor of claim 15, wherein said filters filter the input signal into sufficiently heavily overlapped frequency bands to reduce the ripple in the frequency response, given a slowly swept sine wave input signal, to below about 0.5 dB.

17. The continuous frequency dynamic range compressor of claim 16, wherein said filters filter the input signal into sufficiently heavily overlapped frequency bands to reduce the ripple in the frequency response, given a slowly swept sine wave input signal, to below about 0.25 dB.

18. A hearing aid comprising:

a microphone for detecting sound and generating an electrical signal relating to the detected sound;

an analog to digital converter for converting the electrical signal into a digital signal;

means for digitally processing the digital signal;

a digital to analog converter for converting the processed digital signal to a processed analog signal; and means for converting the processed analog signal into a processed sound signal;

wherein the digital processing means includes a continuous frequency dynamic range compressor including:

a filter bank including a plurality of filters for filtering the digital signal into a plurality of frequency bands;

a plurality of power estimators, each power estimator connected to a filter, each power estimator for estimating the power in the frequency band of its associated filter and generating a power signal related to the power in the frequency band of its associated filter;

a plurality of gain calculators, each gain calculator connected to a power estimator, each gain calculator for calculating a gain related to the power estimated by its associated power estimator;

a plurality of gain applying means, each gain applying means connected to a gain calculator, each gain applying means for applying the gain calculated by its associated gain calculator to the frequency band associated with its associated gain calculator; and means for summing the gain-applied frequency bands;

wherein said filters filter the input signal into sufficiently heavily overlapped frequency bands to reduce the ripple in the frequency response of the filter bank, given a slowly swept sine wave input signal, to less than 2 dB.

19. The hearing aid of claim 18 wherein the compression ratio of said filter bank is at least about 4 and the ripple is below about 2 dB.

20. The hearing aid of claim 18 wherein the compression ratio of said filter bank is between about 1.5 and about 4 and the ripple is below about 1 dB.

* * * * *